US005952789A

United States Patent [19]

Stewart et al.

[11] Patent Number: 5,952,789

[45] Date of Patent: Sep. 14, 1999

[54] ACTIVE MATRIX ORGANIC LIGHT EMITTING DIODE (AMOLED) DISPLAY PIXEL STRUCTURE AND DATA LOAD/ ILLUMINATE CIRCUIT THEREFOR

[75] Inventors: Roger Green Stewart, Neshanic Station; Alfred Charles Ipri, Princeton, both of N.J.

[73] Assignee: Sarnoff Corporation, Princeton, N.J.

[21] Appl. No.: 08/834,067

[22] Filed: Apr. 14, 1997

[51] Int. Cl.[6] ..... G09G 3/10

[52] U.S. Cl. ..... 315/169.4; 315/169.1; 315/169.3; 345/76; 345/46; 345/82

[58] Field of Search ..... 315/169.1, 169.3, 315/169.4; 345/76, 36, 49, 82, 55, 46, 48

[56] References Cited

U.S. PATENT DOCUMENTS

| | | | |
|---|---|---|---|
| 3,753,231 | 8/1973 | Hilsum | 315/169.3 |
| 4,042,854 | 8/1977 | Luo et al. . | |
| 4,047,049 | 9/1977 | Erickson et al. . | |
| 4,298,869 | 11/1981 | Okuno . | |
| 4,393,380 | 7/1983 | Hosokawa et al. . | |
| 4,471,347 | 9/1984 | Nakazawa et al. . | |
| 4,602,192 | 7/1986 | Nomura et al. | 315/169.3 |
| 4,928,095 | 5/1990 | Kawahara . | |
| 4,996,523 | 2/1991 | Bell et al. . | |
| 5,017,914 | 5/1991 | Uchida et al. . | |
| 5,079,483 | 1/1992 | Sato | 315/169.3 |
| 5,142,343 | 8/1992 | Hosgawa et al. . | |
| 5,402,041 | 3/1995 | Kishino et al. | 315/169.1 |
| 5,408,109 | 4/1995 | Heeger et al. . | |
| 5,436,747 | 7/1995 | Suzuki . | |
| 5,455,598 | 10/1995 | Clerc . | |
| 5,652,600 | 7/1997 | Khormaei et al. | 345/76 |

*Primary Examiner*—Don Wong
*Assistant Examiner*—Wilson Lee
*Attorney, Agent, or Firm*—William J. Burke

[57] ABSTRACT

A pixel structure for use in a display using organic light emitting diodes (O-LEDs) is described. Each pixel structure of an overall array includes an organic light emitting diode (O-LED). Additionally, the structure includes circuitry for allowing the structure to operate in three basic modes: write select mode, write deselect mode and an illuminate mode. Hence, the structure includes circuitry for causing the pixel structure to be selected such that data can be written to the pixel structure, said data representative of a programmed current level to be applied to the O-LED; circuitry for causing the pixel structure to be deselected when a pixel structure in a different row is having data written thereto; and circuitry for applying the programmed current level to the OLED, causing the O-LED to illuminate.

12 Claims, 4 Drawing Sheets

ACTIVE MATRIX ORGANIC LIGHT EMITTING DIODE (AMOLED) DISPLAY PIXEL STRUCTURE AND DATA LOAD/ ILLUMINATE CIRCUIT THEREFOR

FIELD OF THE INVENTION

The present invention generally relates to pixel structures and, more particularly, the present invention relates to a pixel structure, having three modes of operation, configured with organic light emitting diodes (O-LEDs).

BACKGROUND OF THE INVENTION

Display technology pervades all aspects of present day life, from televisions to automobile dashboards to lap top computers to wrist watches. At the present time, cathode-ray tubes (CRTs) dominate display applications in the 10–40 inch (diagonal) display size. CRTs, however, have many disadvantages including height, lack of ruggedness, cost, and the need for very high driving voltages.

Recently, passive-matrix liquid-crystal displays (LCDs) and active-matrix liquid crystal displays (AMLCDs) have become dominant in midrange display applications because of their use in lap top computers. For smaller pixel sizes and also for large projection displays, the AMLCD is becoming increasingly important. A major drawback of AMLCDs, however, is the requirement of a back light that substantially increases the size and weight of the display. It also leads to reduced efficiency since the back illumination is applied continuously even for pixels in the off state.

Another approach is the deformable-mirror display (DMD) based on single-crystal silicon technology. In this approach, a micro-machined mirror structure is oriented in either a reflective or dispersive mode depending whether a logic "1" or logic "0" has been written into a corresponding cell. DMD displays must operate in the reflective mode, thus, the optics are more complicated and not as compact or efficient as transmissive or emissive displays. Additionally, like AMLCDs, DMDs require an external light source, thus, they are larger and less efficient than the self-emissive displays.

Field-emission displays (FEDs) may also be considered for many applications. However, FEDs have many of the disadvantages associated with CRTs, particularly the need for cathode voltages over 100 volts, and the corresponding requirement that the thin film transistors (TFTs) have low leakage current. FEDs have relatively lower overall luminous efficiencies due to the reduced efficiency of "lower-voltage" phosphors and the use of high voltage control voltages.

Finally, another type of display, an active matrix light emitting diode (AMEL) display, emits light by passing a current through a light emitting material. In the case of an EL, an alternating current (AC) is passed through an inorganic light emitting material (e.g., PN junction is formed from inorganic semiconductor material such as silicon or gallium arsenide. The inorganic light emitting material is arranged such that dielectrics are present on either side of the emitting material. Due to the existence of the dielectrics, relatively high voltages are required to generate sufficient light from the emitting material. The relatively high voltages are typically between 100–200 volts.

The use of an AC voltage and other factors limit the efficiency of the overall display.

Also, with respect to the stability of inorganic LED displays, the brightness of the light emitting material saturates with applied voltage after a rapid transition from off to on. If the display is operated in a "fully on" and "fully off" mode, any shift in transition voltage with time has only a minimal effect on brightness.

With these disadvantages of the various display technologies in mind, a better type of display would be desirable which requires less voltage, is more efficient and is generally more advantageous for all types of display applications.

SUMMARY OF THE INVENTION

The present invention involves a pixel structure for use in a display using organic light emitting diodes (O-LEDs). Each pixel structure of an overall array includes an organic light emitting diode (O-LED). Additionally, the structure includes circuitry for allowing the structure to operate in three basic modes: write select mode, write deselect mode and an illuminate mode. Hence, the structure includes circuitry for causing the pixel structure to be selected such that data can be written to the pixel structure, said data representative of a programmed current level to be applied to the O-LED; circuitry for causing the pixel structure to be deselected when a pixel structure in a different row is having data written thereto; and circuitry for applying the programmed current level to the OLED, causing the O-LED to illuminate.

BRIEF DESCRIPTION OF THE DRAWINGS

The invention is best understood from the following detailed description when read in connection with the accompanying drawing, in which.

DETAILED DESCRIPTION OF THE INVENTION

Overview

Figure 1:
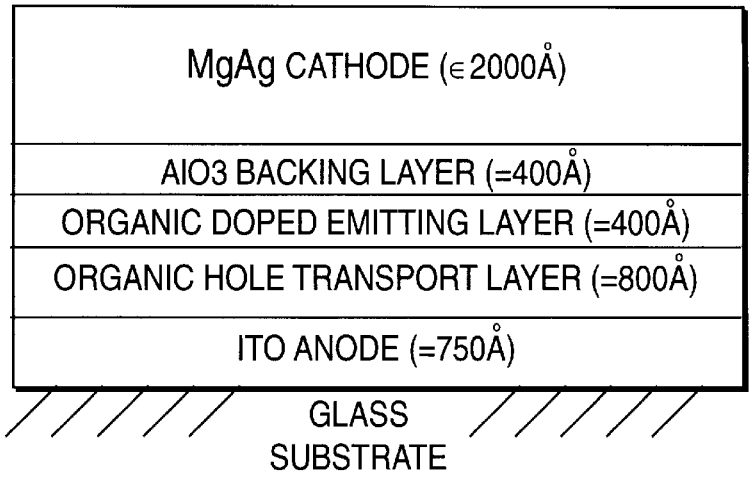
FIG. 1 shows an exemplary illustration of a display fabrication, including organic light emitting diode (O-LED) material, suitable for use with the present invention.

A better alternative to the display technologies described in the BACKGROUND section of this application is an active matrix organic light emitting diode (AMOLED) display. In the case of AMOLED displays, an organic rather than inorganic material is used to form the LED. Examples of using organic material to form an LED are found in U.S. Pat. No. 5,142,343 and U.S. Pat. No. 5,408,109, both of which are hereby incorporated by reference. An exemplary embodiment of the O-LED used with the present invention is described below in detail with reference to FIG. 1.

Briefly, for an O-LED, a direct current (DC) is passed through the organic diode material to generate light. The conduction is in the forward direction. Through experimentation, it has been found that the voltage needed for the light emitting material to emit a given level of light increases with time, hence, the transition voltage from "off" to "on" increases with time without substantial saturation. It has also been found, however, that a given light level (brightness) is relatively stable with the current that is passed through the organic diode material. Additionally, since threshold voltage is sensitive to processing, fixed, small drive voltage levels may be rendered ineffective due to process variation in the O-LED manufacturing process.

The present invention involves an O-LED pixel configuration which is current programmable and is independent of either a shift in the transition voltage of the pixel or a shift in transistor threshold voltage.

The technique of the present invention includes a separate, digitally programmable current source for each column line of a pixel array. For each pixel of a first exemplary embodiment of the present invention, two data lines, D1 and D2, as well as two select lines, S1 and S2, are provided. The combination of data and select lines provides for multi-mode operation of the pixel including a write select mode, a write deselect mode and an illuminate mode. To implement each of the modes, two transistors and a capacitor are operatively configured with the O-LED pixel and the data and select lines. The details of the O-LED pixel configuration and the modes of operation are described below with reference to the figures. Although the exemplary embodiment of the present invention is described in conjunction with an O-LED, it is also contemplated that the present invention could be used with other similar display elements such as an LED.

In the case of AMOLED displays, a DC current is passed through the diode material to generate light. It has been found that the voltage needed to emit a given level of light increases with time and, hence, the transition voltage from "off" to "on" increases with time without substantial saturation. However, it has also been found that a given light level (brightness) is relatively stable with the current that is passed through the light emitting material. For this reason a desirable pixel design supplies a constant current to the light emitting material and may be programmed to a specific current rather than a specific voltage, as is the case with conventional AMEL displays, to emit a given brightness.

Exemplary Embodiment of the Invention

Before describing the pixel driving technique in detail, the structure of an O-LED is described. An important feature of the present invention is the fact that the O-LED materials achieve logic-h of brightness at low drive voltages. Additionally, the current drive nature of the O-LED material significantly reduces the leakage current requirement on the active-matrix drive transistor, thus, the present invention is suitable for low cost glass substrates. The O-LEDs employed in the present invention typically begin to emit light at about 2–10 volts.

Generally, the process for the formation of an overall display using O-LEDs includes several steps:

1) forming polysilicon active-matrix circuitry;
2) integrating the O-LED material with the active-matrix array;
3) integrating color shutters (for color displays); and
4) assembling and testing the completed panel.

As mentioned above, the first step in the exemplary fabrication process is the formation of the active-matrix circuitry. For the present invention, a polysilicon thin-film transistor (TFT) technique is employed. The desired circuitry to be formed is described below in detail with reference to FIGS. 2 and 4.

The second step in the process involves deposition of the LED materials on the active-matrix array.

FIG. 1 shows an exemplary illustration of a O-LED fabrication suitable for use with the present invention. Referring to FIG. 1, first, a transparent conducting electrode, such as Indium Tin Oxide (ITO), is deposited and patterned. This is followed by the deposition of a hole transporting layer, a doped emitting layer and an $AlO_3$ backing layer. The array is completed with the deposition of an MgAg top electrode resulting in the O-LED "stack" shown in FIG. 1.

For the present invention, Table I presents the exemplary thicknesses for each layer of the O-LED stack:

TABLE I

| LAYER | THICKNESS |
|---|---|
| transparent conducting electrode | app. 750 Angstroms |
| transporting layer | app. 800 Angstroms |
| doped emitting layer | app. 400 Angstroms |
| backing layer | app. 400 Angstroms |
| top electrode | app. 2000 Angstroms |

Finally, the display is packaged and tested. Although not shown, the packaging includes a mechanical support for the display, means for making a reliable connection to external electronics and overcoat passivation.

O-LEDs have demonstrated extraordinary efficiencies. The luminous efficiency is as high as 15 l/w. Brightness values of 2000 cd/$m^2$ have been achieved at operating voltages below 10 volts and a current density of 20 ma/cm. Orders of magnitude higher brightness have been measured at higher current densities.

Figure 2:
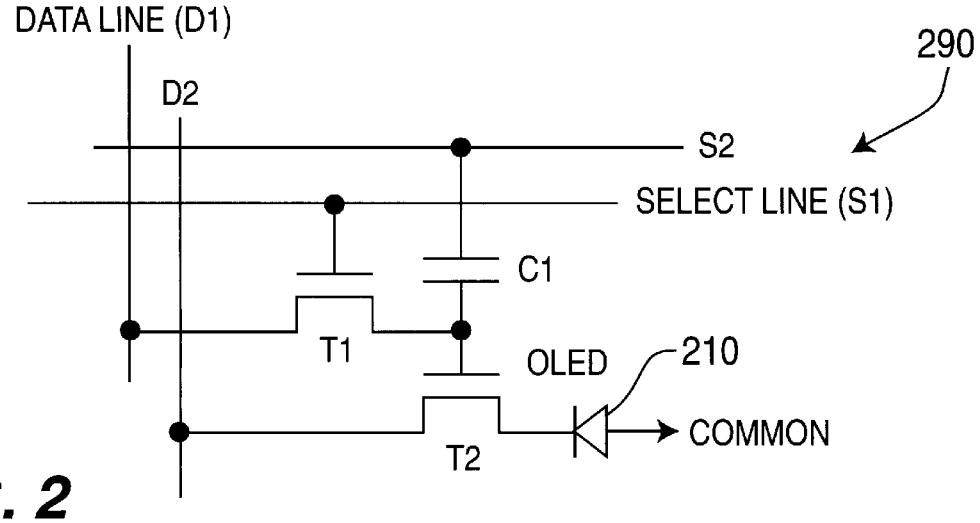
FIG. 2 shows a circuit diagram of a first exemplary embodiment of an O-LED pixel structure in accordance with the present invention.

FIG. 2 shows a circuit diagram of a first exemplary embodiment of an O-LED pixel structure in accordance with the present invention. Because it is contemplated that each pixel structure in a given array of pixels (e.g., 1024×1280) is the same, only a single pixel structure is described. The pixel configuration shown in FIG. 2 is current programmable and is independent of either the shift in the O-LED transition voltage or the shift in transistor threshold voltage.

As shown in FIG. 2, the pixel structure 200 contains an O-LED 210, two transistors, T1 and T2, two lines running in the data direction, D1 and D2, and two lines running in the select direction, S1 and S2. Additionally, pixel structure 200 includes a capacitor C1. In the exemplary embodiment, each transistor includes a source, a gate and a drain and corresponding electrodes.

In particular, the source electrodes of the first transistor T1 is connected to the data voltage line D1. The source electrodes the second transistor T2 is connected to the data current line D2. The gate electrode of the first transistor T1 is connected to the first select line S1. The gate electrode of the second transistor T2 is connected to the second select line S2 by way of capacitor C1. The drain electrode of the first transistor T1 is connected to the gate electrode of the second transistor T2 as well as to the storage capacitor (C1).

Figure 3:
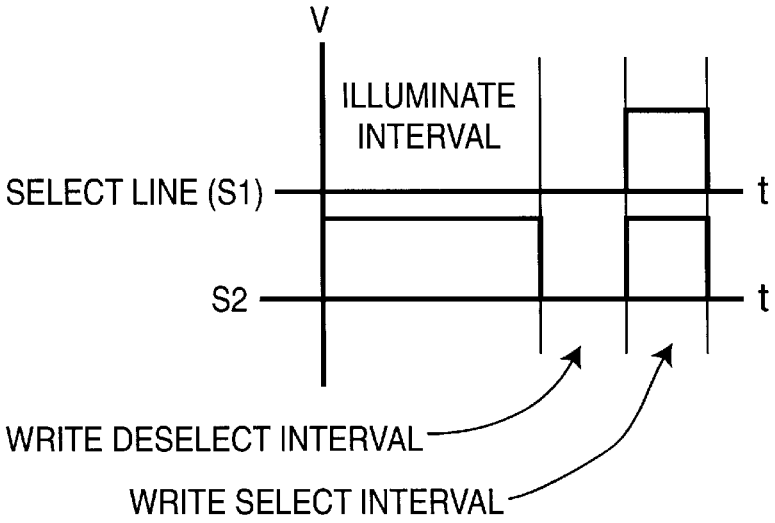
FIG. 3 shows a timing diagram for the exemplary modes of operation used with the O-LED pixel of FIG. 2.

As mentioned above, the combination of data and select lines provides for multi-mode operation of pixel 200 including a write select mode, a write deselect mode and an illuminate mode. Each of the modes is described below with reference to FIGS. 2 and 3 where FIG. 3 shows a timing diagram for the exemplary modes of operation used with the O-LED pixel of FIG. 2.

Turning first to the write select mode, in order to write a predetermined current level (II) and, hence, brightness level into the pixel, transistor T1 is turned on by way of select line S1. Consequently, the voltage on first data line D1 is applied, through transistor T1, to the gate of transistor T2. As the voltage applied to the gate of transistor T2 is increased, transistor T2 turns on and its internal impedance continually decreases until current level I1 is reached on data current line D2 allowing current level I1 to be applied to O-LED 210.

During the write select mode, the select signal S2 is held at a logic-high potential.

Data current line D2 is connected to O-LED 210 through transistor T2 and, therefore, the established current level I1 flows through both transistor T2 and O-LED 210. If there is a shift in the threshold voltage of transistor T2 or the transition voltage of OLED 210, the shift(s) are compensated for by an increase or decrease in the voltage stored across capacitor C1 and applied to the gate of transistor T2. In this manner, any shifts in the operating characteristics of either O-LED 210 or transistor T2 or both will have an insignificant, if any, effect on the current through the LED and, hence, the pixel brightness.

The particular timing for the write select mode, write deselect mode and illumination modes is illustrated in FIG. 3. With reference to FIG. 3, the write select mode, which is the third interval shown on the timing diagram, requires that both select lines be logic-high. That is, the first select line S1 becomes logic-high turning on transistor T1, and the second select line S2 for that particular row also becomes logic-high (i.e., write select mode) which allows transistor T2 to be turned on.

With regard to the write deselect mode, however, the second select lines S2 for all the other rows are made logic-low (i.e., write deselect modes). In this manner, the second select line S2 is used to turn off all T2 transistors on rows of the array to which data is not being written. As shown in FIG. 2, this is accomplished by coupling the second select lines S2 into the storage node through capacitor C1. When select line S2 is logic-low, for the write deselect mode, regardless of the potential stored on capacitor C1, the signal at the gate of transistor T2 will be a logic-low ensuring that current does not pass through transistor T2 or O-LED 210. The current being sensed on data current line D2, therefore, is only flowing through the selected O-LED and no other pixels along the column.

During the illuminate mode, as shown in FIG. 3, the first select line S1 is made logic-low thereby turning off transistor T1. At the same time, the second select line S2 is made logic-high. The combination of the logic-high potential on select line S2 and the stored potential on capacitor C1 drives the gate of transistor T2 to its programmed level. In this manner, the O-LED illuminates at its programmed current level (i.e., as programmed during the write select mode) or brightness. Also, during the illuminate mode, certain control of data line D2 is performed as described below with reference to FIG. 4.

Figure 4:
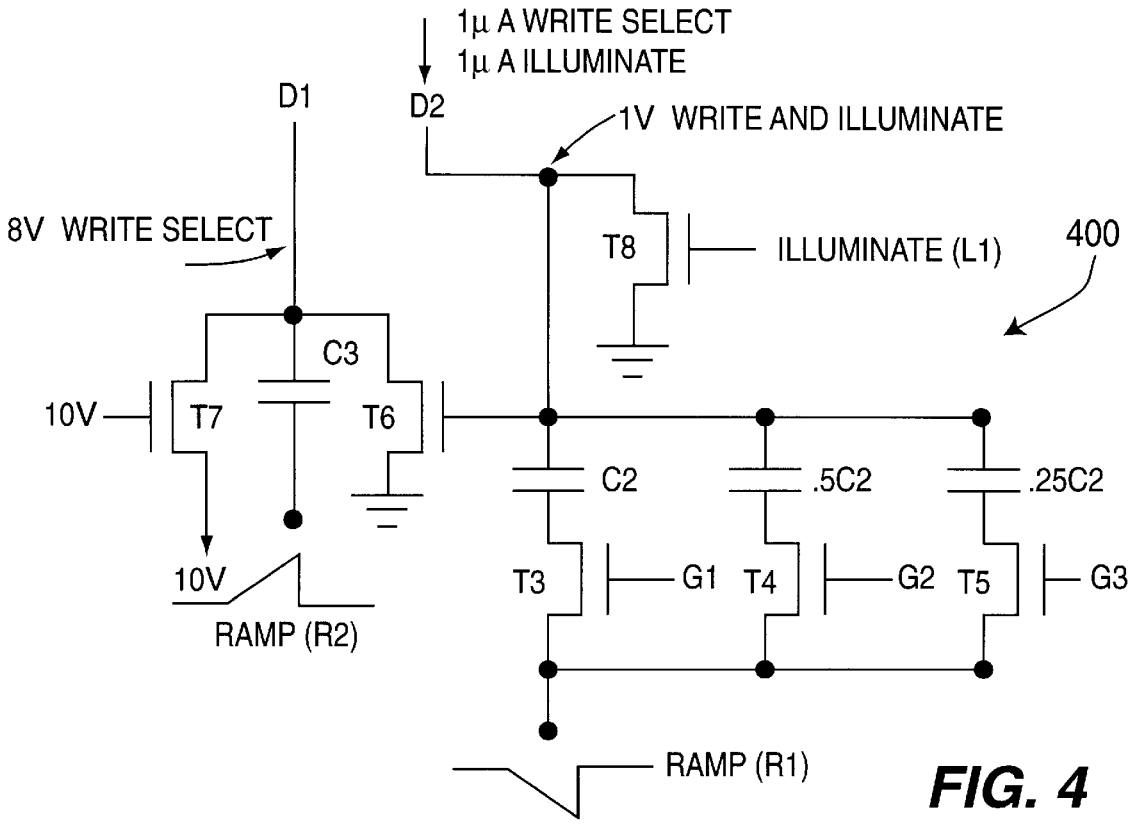
FIG. 4 shows a circuit diagram of a data scanner (or current source) suitable for use with the O-LED pixel of FIG. 2.

Since the pixel structure 200 needs to be programmed with a specific current level, a unique current generating circuit has been developed to interface with the exemplary pixel structure. FIG. 4 shows a circuit diagram of an exemplary current generating circuit 400 suitable for use with the O-LED pixel structure of FIG. 2.

With reference to FIG. 4, data lines D1 and D2 are the same data lines shown in FIG. 2. As shown, by coupling data lines D1 and D2 from the current generating circuit 400 of FIG. 4 to the data lines of pixel structure 200 of FIG. 2, a closed constant current loop can be formed which includes the pixel of a selected row.

As seen in FIG. 4, transistors T3-TS are coupled in parallel. Each of the transistors receives an input on its gate which collectively represent the programmed digital voltage level. Each of the transistors, however, is respectively coupled in series with a capacitor which is appropriately weighted for generated a desired and programmable current value. The combined outputs of the capacitors C2, 0.5C2 and 0.25C2) are coupled to the source of transistor T8 as well as the gate of transistor T6. Transistor T8 is used for controlling the voltage on data current line D2 during the illuminate mode. The connection to T6 is employed for the completing the closed loop so the current supplied on data current line D2 can be controlled.

In particular, to write data to a pixel, the programming digital voltage levels G1–G3 are applied to transistors T3–T5 and a negative voltage ramp (R1) is connected to the sources of transistors T3–T5. The rate of change of the voltage with time for ramp R1, times the effective capacitance (C*dV/dT), sets a unique current level which is connected to D2. It is noted that the effective capacitance is based on the collective capacitive value of the capacitors (i.e., C2, 0.5C2 and 0.25C2) coupled by way of their respective transistors. Ideally, the voltage level on data current line D2 would remain close to ground potential as this will be the illumination voltage level on data current line D2 (in the illuminate mode, a logic-high signal L1 couples data current line D2 to ground potential through transistor T8).

Regarding data voltage line D1, transistor T6 and transistor T7 form an inverter to amplify the voltage provided by the current source on data current line D2 and this inverted voltage level is connected to data voltage line D1. The voltage on data voltage line D1 is further increased through the "boot strap" effect of positive voltage ramp R2 and capacitor C3. This circuit reaches an equilibrium condition at which the OLED 210 is driven by a programmed current defined by the signals G1, G2 and G3.

As mentioned above, during the illuminate mode, certain control of data line D2 is performed. In particular, during the illuminate mode, transistor T8 is turned on in order to bring the data current line D2 to ground potential. It is noted that transistor T8 is a relatively large transistor so that it can handle all of the current through all of the OLED's connected to a specific data line.

By way of example and as shown on FIG. 4, during operation, the exemplary current on D2 during the write mode is 1 microAmp and during illuminate mode is 1 mA. Also, the voltage at the source of T8 is 1 volt. The exemplary voltage on D1 is 8 v during write mode and a "don't care" during illuminate mode.

The combination of pixel structure 200 and current generating circuit 400 make it possible to design high-quality O-LED displays with good grey scale uniformity and high lifetime despite instabilities in either the LEDs or the TFTs. It is noted that circuit 400 is especially well suited for driving polysilicon and amorphous silicon AMOLED displays.

Figure 5:
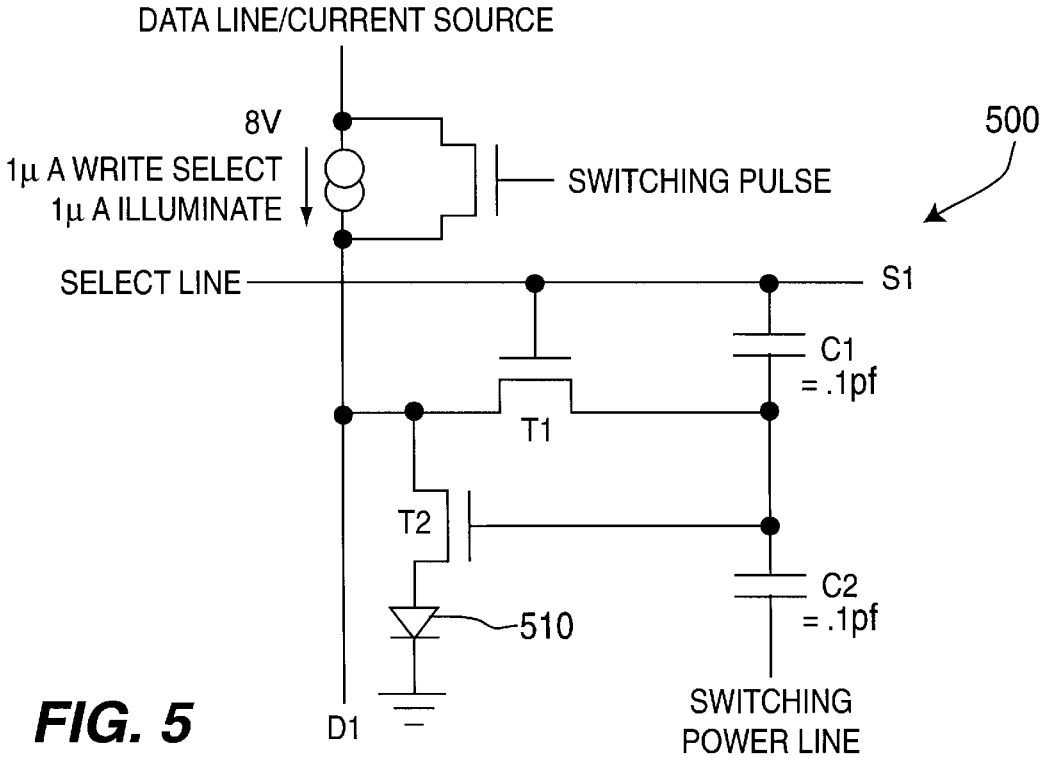
FIG. 5 shows a circuit diagram of a second exemplary embodiment of an O-LED pixel structure in accordance with the present invention.

FIG. 5 shows a circuit diagram of a second exemplary embodiment of O-LED pixel element in accordance with the present invention. The pixel structure 500 shown in FIG. 5 is similar to that shown in FIG. 2, including its multi-mode operation. As seen, however, there are some differences between pixel structure 200 and pixel structure 500. For example, the pairs of data and select lines of FIG. 2 have been replaced with a single data line and a single select line in the pixel structure shown in FIG. 5.

Turning to FIG. 5, the pixel structure 500 contains an O-LED 510, two transistors, T1 and T2, one line running in the data direction, D1, and one line running in the select direction, S1. In the exemplary embodiment, each transistor includes a source, a gate and a drain and corresponding electrodes. Additionally, and similar to pixel structure 200, pixel structure 500 includes a capacitor C1 on which a potential level which determines the pixel illuminate level is stored. The source of the first transistor T1 is connected to the data line D1. The source electrode of the second transistor T2 is connected to the data line D1. The gate electrode of the first transistor T1 is connected to the select line S1. The gate electrode of the second transistor T2 is connected to the select line S1 by way of capacitor C1. The drain electrode of the first transistor T1 is connected to the gate electrode of the second transistor T2 as well as to the storage capacitor C1. Furthermore, a switching power line is coupled to the gate of transistor T2, the drain of transistor T1 and to capacitor C1 all through capacitor C2.

Like the operation of pixel structure 200, the combination of data and select lines provides for multi-mode operation of pixel 500 including a write select mode, a write deselect mode and an illuminate mode.

With regard to the write select mode, where pixel structure 200 required that both select lines be made logic-high, in pixel structure 500, only the single select line is made logic-high. Doing so couples the capacitor C1 node logic-high, similar to making both select lines in pixel structure 200 logic-high, and it also turns on transistor T1 placing pixel structure 500 into a write mode. At this point, the desired current is applied on data line D1 in an attempt to drive pixel 510. However, until transistor T2 is sufficiently turned on, the current from data line D1 passes through transistor T1 to the gate of transistor T2. The equilibrium point, where the gate of transistor T2 reaches a sufficient voltage to pass the desired current through transistor T2, is reached quickly. Upon reaching this point, pixel structure 500 is then programmed with the desired current level because the combined potential on select line S1 and capacitor C1 holds the gate of transistor T2 at a potential sufficient to conduct the programmed current.

With regard to the write deselect mode, when select line S1 is made logic-low, transistor T1 is turned off and the same negative excursion occurs on C1, as it does in pixel structure 200, to unconditionally switch off every unselected pixel.

With regard to the illuminate mode, select line S1 is made logic-high and D1 is made logic-low. In addition, a switching pulse shunts the current source, causing the data line to be connected to a source of operating potential. At the same time, the switching pulse connects the source of operating potential to the capacitor C2. The stored charge at the junction of capacitors C1 and C2 and the logic-high level on select line S causes the transistor T2 to conduct only the programmed current through the O-LED 510. The gate of T2 is thereby returned to a value close to that programmed during write select mode.

By way of example and as shown on FIG. 5, during operation, the exemplary current on D1 during the write mode is 1 microAmp and during illuminate mode is 1 mA. Again, the exemplary voltage on D1 is 8 v during write mode.

Although not described in detail, additional contemplated embodiments of alternative pixel structures are shown in FIGS. 6–9. One skilled in the art, with the present disclosure in hand, would appreciate how each exemplary embodiment operates given the described operation of the embodiments described with respect to FIGS. 2 and 5 and the current generating circuit of FIG. 4. Depending on the particular embodiment, current generating source 400 may require minor modifications to accommodate the necessary interconnections and timing.

Figure 6:
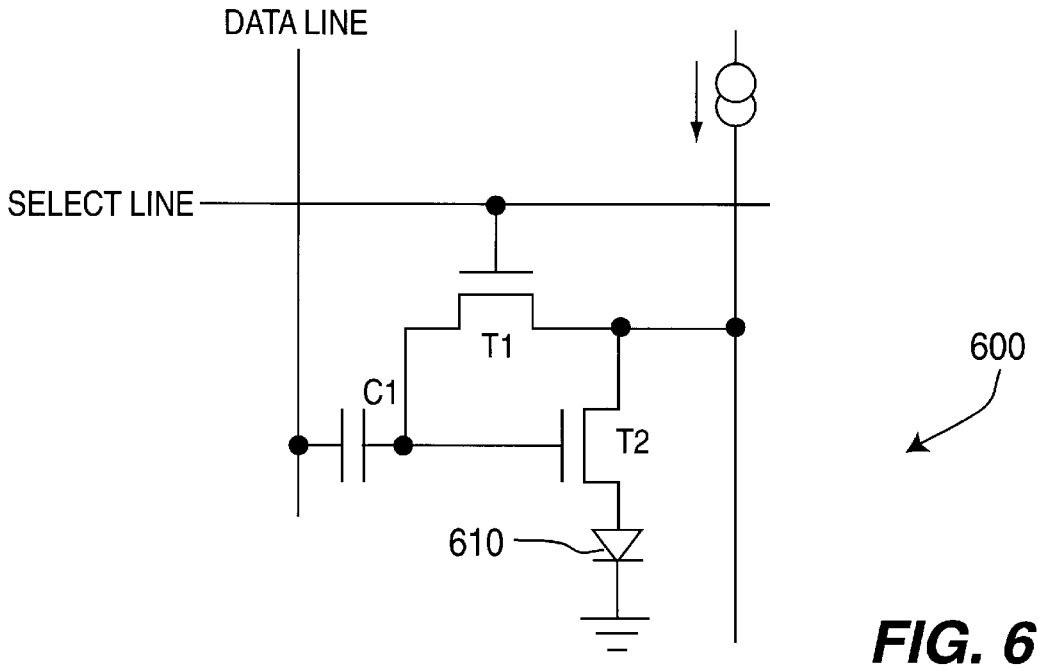
FIG. 6 shows a circuit diagram of a third exemplary embodiment of an O-LED pixel structure in accordance with the present invention.

In particular, FIG. 6 shows a circuit diagram of a third exemplary embodiment of an O-LED pixel element in accordance with the present invention. Briefly, the data and select lines are operated to place a potential related to a programmed current level on C1. Then, during illuminate mode, the stored potential drives the gate of transistor T2 to the appropriate level allowing an appropriate amount of current to pass through O-LED 610.

Figure 7:
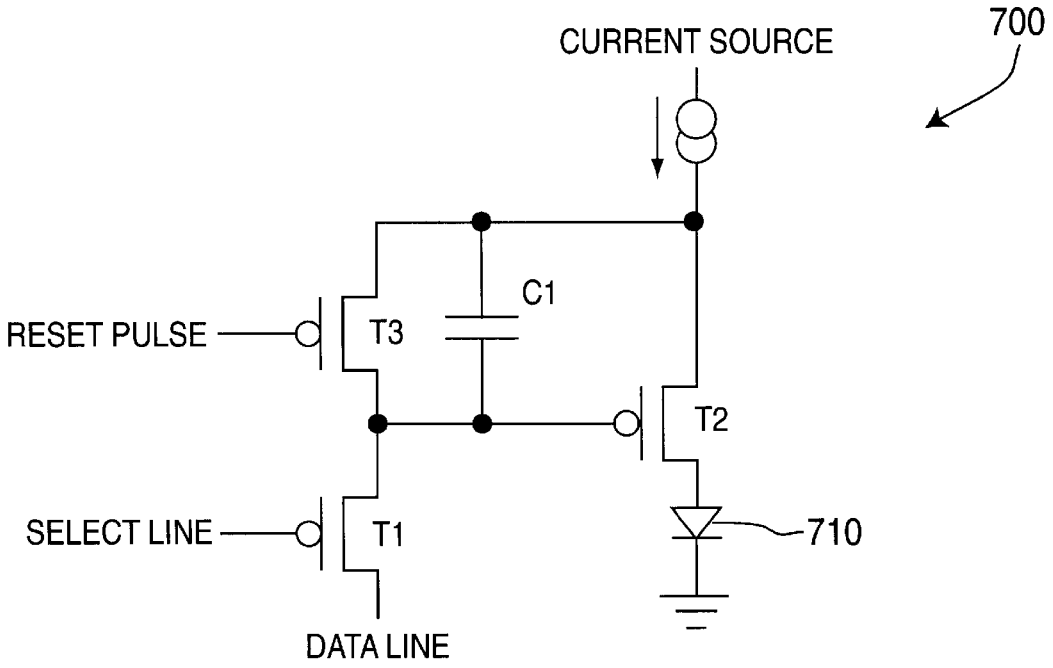
FIG. 7 shows a circuit diagram of a fourth exemplary embodiment of an O-LED pixel structure in accordance with the present invention.

FIG. 7 shows a circuit diagram of a fourth exemplary embodiment of an O-LED pixel element in accordance with the present invention. Briefly, as seen in FIG. 7, the transistors T1, T2 and T3 are fabricated using PMOS technology. The select line and the current source, as well as the data line, are operated to place a potential related to a programmed current level on C1. During an illuminate mode, the stored negative potential drives the gate of transistor T2 to the appropriate level allowing an appropriate amount of current to pass through O-LED 710. Additionally, the pixel structure 700 includes a reset mechanism in the form of T3 which, when turned on, causes stored potential on C1 to discharge.

Figure 8:
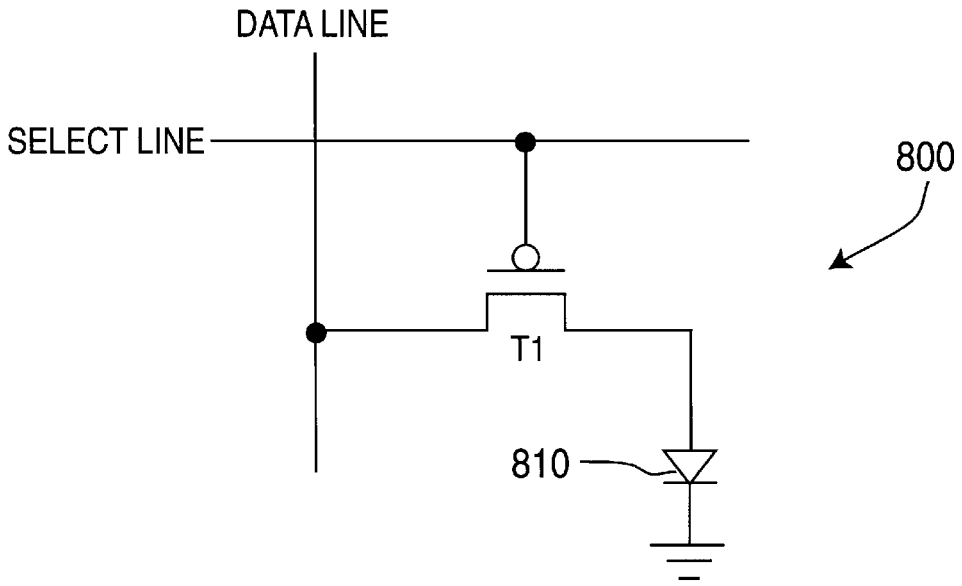
FIG. 8 shows a circuit diagram of a fifth exemplary embodiment of an O-LED pixel structure in accordance with the present invention.

FIG. 8 shows a circuit diagram of a fifth exemplary embodiment of an O-LED pixel element in accordance with the present invention. The fifth exemplary embodiment programs in a similar manner. This embodiment, however, does not include frame storage and is therefore suitable only for smaller displays.

Figure 9:
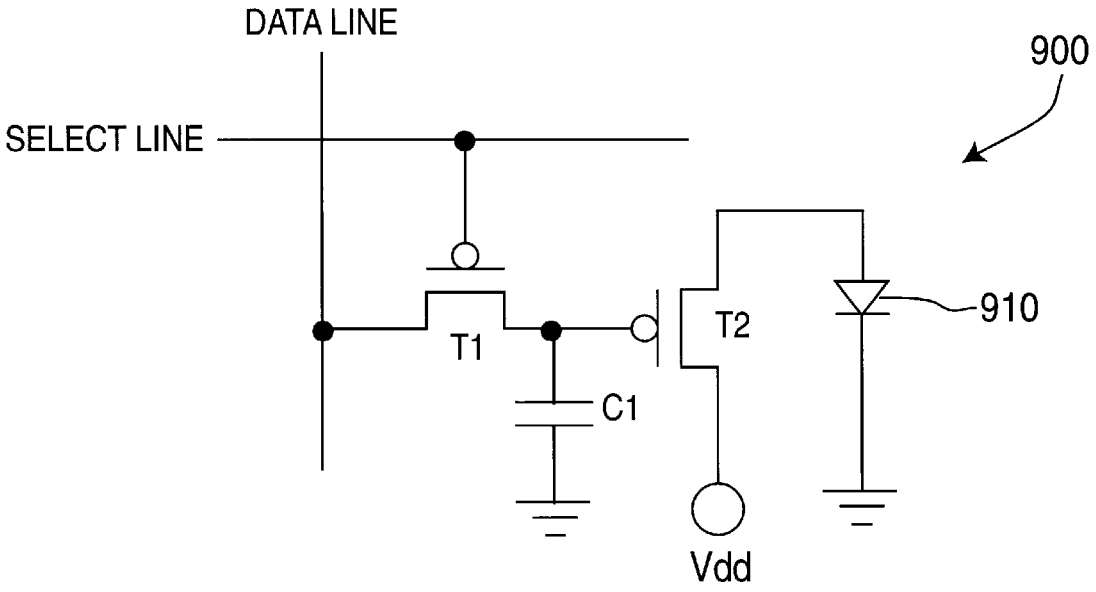
FIG. 9 shows a circuit diagram of a sixth exemplary embodiment of an O-LED pixel structure in accordance with the present invention.

FIG. 9 shows a circuit diagram of a sixth exemplary embodiment of an O-LED pixel element in accordance with the present invention. Similar to the embodiment of FIG. 7, this embodiment employs PMOS transistors. Briefly, the data and select lines are operated to place a potential related to a programmed current level on C1 which, in this embodiment, has one electrode grounded. Then, during illuminate mode, the stored potential drives the gate of transistor T2 to the appropriate level allowing an appropriate amount of current, from Vdd, to pass through O-LED 910.

Although the invention is illustrated and described herein with reference to particular embodiments, the invention is not intended to be limited to the details shown. Rather, various modifications may be made in the details within the scope and range of equivalents of the claims and without departing from the spirit of the invention.

What is claimed:

1. A pixel structure for use in a display comprising:

a light emitting diode (LED);

means for causing the pixel structure to be selected such that a data voltage can be written to the pixel structure, said data representative of a desired programmed current level to be applied to the LED to produce a desired brightness level;

means for monitoring the current flowing in the LED during write programming;

feedback means for adjusting the data voltage during write programming to obtain the desired programmed current level;

means for causing the pixel structure to be deselected when a pixel structure in a different row is having data written thereto; and means for applying the programmed current level to the LED, causing the LED to illuminate.

2. A pixel structure for use in a display comprising:

a light emitting diode (LED);

means for causing the pixel structure to be selected such that a data voltage can be written to the pixel structure, said data representative of a programmed current level to be applied to the LED to produce a desired brightness level;

means for causing the pixel structure to be deselected when a pixel structure in a different row is having data written thereto; and means for applying the programmed current level to the LED, causing the LED to illuminate;

wherein the means for causing the pixel structure to be deselected selectively blocks current flowing through the LED while write programming other pixel structures.

3. The pixel structure of claim 2 wherein the means for causing the pixel structure to be selected includes two independently-controlled select lines and a transistor.

4. The pixel structure of claim 2 wherein the means for causing the pixel structure to be deselected includes two independently-controlled select lines and a transistor.

5. The pixel structure of claim 2 wherein the means for applying includes a capacitor and a transistor.

6. An array of pixel structures, coupled to a digital current source, each pixel structure comprising:

first and second data lines;

first and second select lines;

first and second transistors, each transistor having a source electrode, a gate electrode and a drain electrode;

a capacitor for storing a potential representative of a programmed current level; and an organic light emitting diode (O-LED), wherein the source electrode of the first transistor is coupled to the first data line, the source electrode of the second transistor is coupled to the second data line, the gate electrode of the first transistor is coupled to the first select line, the gate electrode of the second transistor is coupled to the drain electrode of the first transistor and to the second select line by way of the capacitor, the drain of the second transistor is coupled to the O-LED.

7. The array of pixel structures of claim 6, further comprising means, coupled to the first and second data lines, for driving each pixel structure in the array in three modes including a write select mode, a write deselect mode and an illuminate mode.

8. An array of pixel structures, coupled to a digital current source, each pixel structure comprising:

first and second data lines;

first and second select lines;

first and second transistors, each transistor having a source electrode, a gate electrode and a drain electrode;

a capacitor;

an organic light emitting diode (O-LED), wherein the source electrode of the first transistor is coupled to the first data line, the source electrode of the second transistor is coupled to the second data line, the gate electrode of the first transistor is coupled to the first select line, the gate electrode of the second transistor is coupled to the drain electrode of the first transistor and to the second select line by way of the capacitor, the drain electrode of the second transistor coupled to the O-LED; and means, coupled to the first and second data lines, for driving each pixel structure in the array in three modes including a write select mode, a write deselect mode and an illuminate mode, wherein the write select mode causes the pixel structure to be selected such that a programmed current level can be established in the pixel structure, said programmed current level representative of a desired brightness to be displayed on the O-LED, the write deselect mode causes the pixel structure to be deselected when a pixel structure in a different row is having data written thereto, and the illuminate mode causes the O-LED to be driven at the programmed current level causing the pixel to illuminate.

9. A method for driving a pixel structure, including an organic light emitting diode (O-LED), for use in a display comprising:

causing the pixel structure to be write selected such that data can be written to the pixel structure, said data representative of a programmed current level to be applied to the O-LED;

causing the pixel structure to be write deselected when a pixel structure in a different row is having data written thereto; and applying the programmed current level to the O-LED, causing the O-LED to illuminate.

10. The method of claim 9, wherein the pixel structure includes two select lines and both select lines are made logic-high when the pixel structure is write selected.

11. The method of claim 9, wherein the pixel structure includes two select lines and both select lines are made logic-low when the pixel structure is write deselected.

12. The method of claim 9, wherein the pixel structure includes two select lines and one select line is made logic-high while the other select line is made logic-low when the pixel structure is illuminated.

* * * * *